US006177767B1

(12) United States Patent
Asai et al.

(10) Patent No.: US 6,177,767 B1
(45) **Date of Patent: *Jan. 23, 2001**

(54) LUMINESCENT DEVICE HAVING DRIVE-CURRENT CONTROLLED PIXELS AND METHOD THEREFOR

(75) Inventors: Nobutoshi Asai, Kanagawa; Yasunori Kijima, Tokyo, both of (JP)

(73) Assignee: Sony Corporation, Tokyo (JP)

( * ) Notice: Under 35 U.S.C. 154(b), the term of this patent shall be extended for 0 days.

This patent is subject to a terminal disclaimer.

(21) Appl. No.: 09/154,501

(22) Filed: Sep. 17, 1998

Related U.S. Application Data

(63) Continuation of application No. 08/726,831, filed on Oct. 8, 1996, now Pat. No. 5,886,474.

(30) Foreign Application Priority Data

Oct. 13, 1995 (JP) ..... P07-291808

(51) Int. Cl.[7] ..... H01J 29/70

(52) U.S. Cl. ..... 315/169.1; 315/169.3; 345/76

(58) Field of Search ..... 315/169.1, 169.3, 315/349, 366; 345/76, 77, 78

(56) References Cited

U.S. PATENT DOCUMENTS 4,032,818 * 6/1977 Chan ..... 315/169 R
4,525,653 * 3/1999 Smith ..... 315/366
4,996,523 * 2/1991 Bell et al. ..... 340/781

* cited by examiner

*Primary Examiner*—David Vu
(74) *Attorney, Agent, or Firm*—Ronald P. Kananen; Radr, Fishman & Grauer

(57) ABSTRACT

A luminescent device (for example an autoluminescent flat display and particularly an organic electroluminescent device or display using an organic thin film as an electroluminescent layer) having a plurality of luminescing units (pixels PX) each selectively made to luminesce by a current is provided with a control part (current control circuit part 40) for accurately controlling the brightness of the luminescing units by controlling the current flowing through each luminescing unit on the basis of a brightness signal from outside, which is preferably supplied as preprogrammed memory information. As a result, it is possible to realize distinct luminescing (image display) at all times even with a passive matrix type pixel structure.

6 Claims, 12 Drawing Sheets

LUMINESCENT DEVICE HAVING DRIVE-CURRENT CONTROLLED PIXELS AND METHOD THEREFOR

This application is a continuation of application Ser. No. 08/726,831 filed Oct. 8, 1996, now U.S. Pat. No. 5,886,474.

BACKGROUND OF THE INVENTION

1. Field of the Invention

This invention relates to a luminescent device (for example an autoluminescent flat display and particularly an organic electroluminescent device or display using an organic thin film as an electroluminescent layer) and a driving method thereof.

2. Prior Art

An organic electroluminescent device (hereinafter also referred to as an organic EL device) is of 1 $\mu$m or less in film thickness and can convert electrical energy into light and form a luminescing surface when a current is passed through it and therefore has ideal characteristics as an autoluminescent display device, and in recent years vigorous research and development of these devices has been being carried out.

FIG. 1 shows an organic EL device 10 as an example of a conventional luminescent device. This organic EL device 10 is made by sequentially forming an ITO (Indium Tin Oxide) transparent electrode 5, a hole transfer layer 4, a luminescent layer 3, an electron transfer layer 2 and a cathode (for example an aluminum electrode) 1 on a transparent substrate (for example a glass substrate) 6 by for example vacuum vapor deposition.

When a d.c. voltage 7 is selectively impressed across the cathode 1 and the transparent electrode 5, which is an anode, holes supplied through the transparent electrode 5 pass through the hole transfer layer 4, electrons supplied through the cathode 1 pass through the electron transfer layer 2, the holes and the electrons arrive at the luminescent layer 3 and electron-hole recombination takes place and luminescing 8 of a predetermined wavelength occurs in this luminescent layer 3 and can be observed from the transparent substrate 6 side.

The luminescent layer 3 can be made to contain, for example a zinc complex, and may be a layer essentially consisting of zinc complex only (a plurality of different zinc complexes can be used together) or may be a layer comprising a fluorescent substance added to a zinc complex. Also, zinc complex and other luminescent substances such as anthracene, naphthalene, phenanthrene, pyrene, chrysene, perylene, butadiene, coumarin, acridine and stilbene can be used together. This kind of zinc complex or mixture of zinc complex and fluorescent substance can be included in the electron transfer layer 2.

FIG. 2 shows another conventional example, an organic EL device 20 wherein the luminescent layer 3, is dispensed with, zinc complex or a mixture of zinc complex and fluorescent substance is included in the electron transfer layer 2 and luminescing 18 of a predetermined wavelength occurs at the interface of the electron transfer layer 2 and the hole transfer layer 4.

FIG. 3 shows a specific example of a case wherein the organic EL device described above is used as a passive matrix (or simple matrix) display. That is, stacks of organic layers (hole transfer layers 4, luminescent layers 3 and electron transfer layers 2) are disposed between cathodes 1 and anodes 5, these electrodes are disposed in the form of stripes intersecting with each other in the form of a matrix, signal voltages are impressed in time series by a brightness signal circuit 30 and a control circuit 31 comprising a shift register and areas where the electrodes intersect are thereby selectively made to luminesce as pixels. Accordingly, by means of this kind of construction, an organic EL device can be used not only of course as a display but also as an image reproducing device. Also, the above-mentioned pattern of stripes can be provided for each of the colors red (R), green (G) and blue (B) to make a full-color or multicolor display.

It is known that the luminescing brightness of an organic EL device, in the practical brightness area, is roughly proportional to the current (hereinafter also referred to as the device current or the pixel current) flowing through the device (specifically, the pixel).

However, in a passive matrix, when brightness data is supplied to columns as voltages, even if the current-voltage characteristics of the devices are fixed, depending on how many columns pixels of which are to be illuminated in a line and at what brightness, the current flowing through the line changes, and the further a device is along the line electrode (for example one of the above-mentioned electrodes 5) from an electrode connecting to outside, the more greatly the potential of the line electrode side is liable to fluctuate.

Consequently, because the voltage across each pixel is not just the voltage applied to the column electrode (for example, one of the above-mentioned electrodes 1), and fluctuates, there has been the problem that it is not possible to control brightness and it is difficult to display an image. Furthermore, there is a tendency for the devices to increase in resistance with age deterioration, and this makes controlling the brightnesses of pixels by means of voltage even more difficult.

The difficulty of controlling the brightnesses of pixels by means of voltage will now be explained specifically with reference to FIG. 4.

FIG. 4 is an equivalent circuit of a line of a passive matrix. Pixels PX can be regarded as light emitting diodes D connected in a forward direction. The number of columns is n, the resistance of each pixel in the forward direction is R, the resistance of the line electrode 5 between pixels is R' and the resistance of the lead part of the line electrode 5 is R".

Now, considering a case wherein all the pixels are to be illuminated at a certain fixed brightness, the current flowing through each device (each pixel) at this time will be written i. At this time, due to voltage drop the potential of the line electrode 5 at the device $PX_1$ nearest to a power supply connected to one end (the upstream end as seen from the flow of current) of the line electrode 5 falls by the amount niR" from the power supply voltage, i.e. becomes −niR". The potential of the line electrode 5 at the device $PX_n$ furthest from the power supply falls due to voltage drop by the amount $\{niR''+(n-1)iR'+(n-2)iR'+\ldots iR'\}$ from the power supply voltage, i.e. becomes $\{-niR''-(n^2-n)iR'/2\}$. On the other hand, when just the furthest device $PX_n$ is to be illuminated at that brightness, the potential of the line electrode at that device falls due to voltage drop by the amount $\{iR''+(n-1)iR'\}$ from the power supply voltage, i.e. becomes $-\{iR''+(n-1)iR'\}$.

Summarizing this yields the following:

[1] When all the pixels are to be illuminated at a certain fixed brightness:

The potential of the line electrode at the nearest device $PX_1$ to the power supply is −niR".

The potential of the line electrode at the furthest device $PX_n$ from the power supply is $-niR''-(n^2-n)iR'/2$.

[2] When just the furthest device $PX_n$ from the power supply is to be illuminated at a certain fixed brightness:

The potential of the line electrode at the device $PX_n$ is $-iR''-(n-1)iR'$.

When illuminating a simple matrix of this kind, because the lines are illuminated one by one, each pixel is not continuously illuminated but rather is illuminated for a period of 1/m (where m=the number of lines), and to obtain a brightness of 100 cd/m$^2$ is it necessary to illuminate the pixels at a peak brightness of 100 m·cd/m$^2$.

If m is assumed to be 500 and the current density at this time during luminescing is 1000 mA/cm$^2$ and the pixel size is 0.3×0.3 mm in a general EL device, the current is 900 $\mu$A. Also, the resistance R' of the line electrode between devices is about 20Ω in the case of ITO and about 0.2Ω in the case of an interconnection made of a metal such as aluminum. Supposing that the lead length is 5 mm, R" is about 300Ω in the case of an ITO electrode and about 3Ω in the case of a metal electrode. Also, the number of columns n will be assumed to be 1000.

Here, substituting specific numerical values into the above equations to compare the potentials of the line electrode at the furthest device $PX_n$ from the power supply in the above-mentioned cases [1] and [2] yields the following:

(a) When the line electrode consists of a metal interconnection:

[1] When all the pixels are to be illuminated at a certain fixed brightness:

$$-niR''-(n^2-n)iR'/2$$

$$\approx -1{,}000\times 900\times 10^{-6}A\times 3\Omega-(1{,}000{,}000-1{,}000)\times 900\times 10^{-6}A\times 0.2\Omega/2$$

$$=-92.61V$$

[2] When just the pixel $PX_n$ is to be illuminated at a certain fixed brightness:

$$-iR''-(n-1)iR'$$

$$\approx 900\times 10^{-6}A\times 3\Omega-(1{,}000-1)\times 900\times 10^{-6}A\times 0.2\Omega$$

$$=-0.18V$$

Therefore, the potential of the line electrode at the pixel $PX_n$ fluctuates by as much as 92.43V depending on the display state of the screen.

(b) When the line electrode consists of ITO:

[1] When all the pixels are to be illuminated at a certain fixed brightness:

$$-niR''-(n^2-n)iR'/2$$

$$\approx -1{,}000\times 900\times 10^{-6}A\times 300\Omega-(1{,}000{,}000-1{,}000)\times 900\times 10^{-6}A\times 20\Omega/2$$

$$=-9261V$$

[2] When just the pixel $PX_n$ is to be illuminated at a certain fixed brightness:

$$-iR''-(n-1)iR'$$

$$\approx 900\times 10^{-6}A\times 300\Omega-(1{,}000-1)\times 900\times 10^{-6}A\times 20\Omega$$

$$=-18V$$

Therefore, the potential of the line electrode at the pixel $PX_n$ fluctuates by as much as 9243V depending on the display state of the screen. In this case, it is impossible to make a practical circuit.

From the above results it can be seen that even using metal line electrodes having very low resistance, voltage fluctuations of a level close to 90V occur, and when ITO line electrodes are used, because the voltage fluctuations become much larger, it is extremely difficult to control brightness by means of voltages applied to the pixels. Indeed, in the case of ITO line electrodes, the voltage fluctuations are so great that it is not even possible to construct a practical circuit.

OBJECT AND SUMMARY OF THE INVENTION

Accordingly, an object of the invention is to realize distinct luminescence at all times by taking the pixel as a luminescing unit as described above and accurately controlling the brightness of each luminescing unit by controlling the amount of current flowing through that luminescing unit.

The present inventors, as a result of various studies into the problem points of the conventional technology described above, on the basis of the recognition that controlling the brightnesses of pixels by means of voltage is difficult, conceived the idea of controlling the brightnesses of pixels by controlling the current flowing through each pixel. However, because with conventional approaches it has been usual to transmit electrical signals for control as voltages, a circuit for converting voltage to current was needed.

Accordingly, the present inventors found a method by which it is possible to carry out this kind of current control effectively and thereby arrived at the present invention.

That is, the invention provides a luminescent device having a plurality of luminescing units (for example the pixels PX discussed below; similarly hereinafter) and so constructed that these luminescing units are each selectively made to luminesce by a current, and provided with a control part (for example the current control circuit part 40 discussed below; similarly hereinafter) for controlling the currents flowing through the plurality of luminescing units on the basis of a brightness signal from outside.

The invention also provides a luminescent device driving method for, when selectively causing each of a plurality of luminescing units to luminesce by means of a current, controlling the currents flowing through respective ones of the plurality of luminescing units on the basis of a brightness signal from outside.

With a luminescent device and driving method thereof according to the invention, by providing a current control circuit part for detecting the current flowing through each luminescing unit and controlling this current according to a brightness signal (voltage signal) from outside, it is possible to carry out brightness control accurately whatever the way in which the luminescing units are being made to luminesce (and particularly when forming images as a display).

DETAILED DESCRIPTION OF THE PREFERRED EMBODIMENTS

Figure 1:
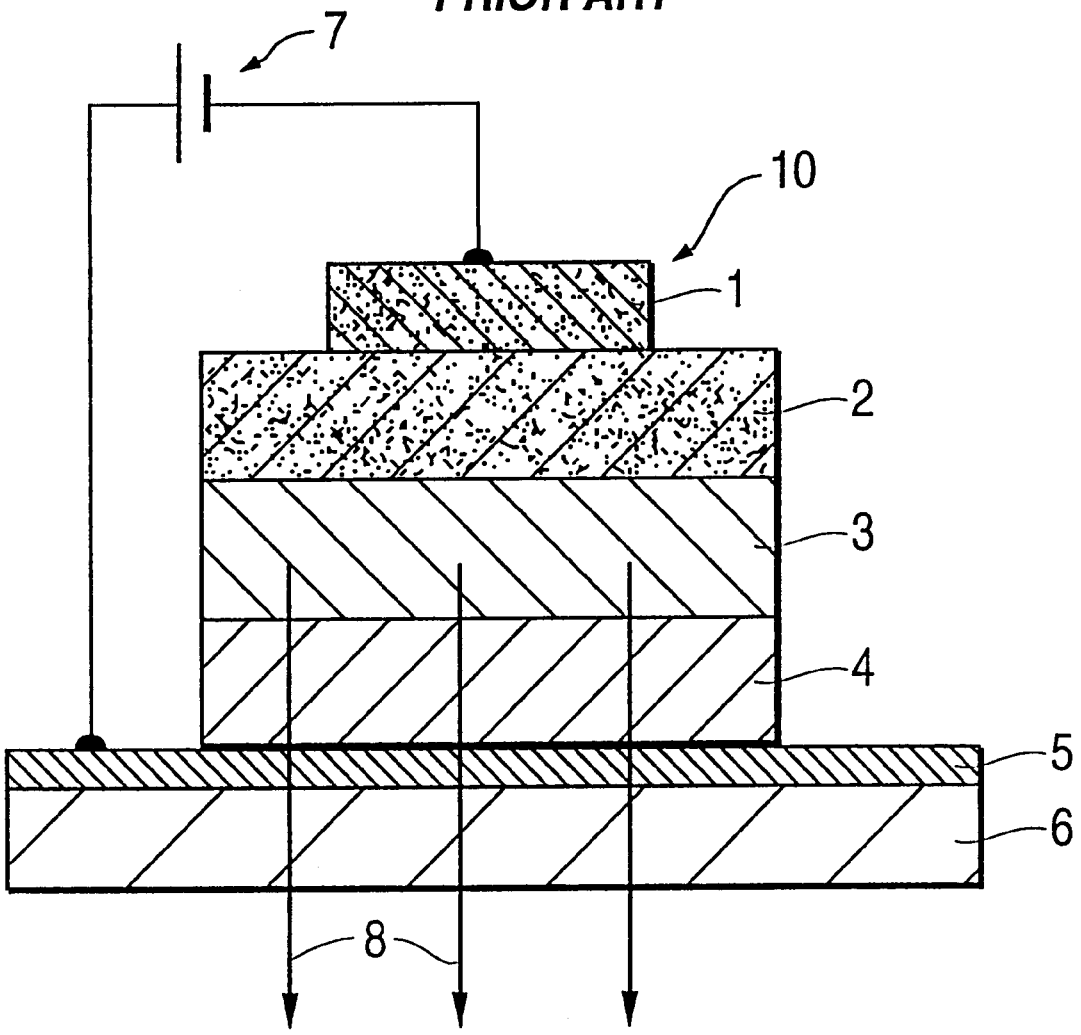
FIG. 1 PRIOR ART
FIG. 1 is a schematic sectional view of an example of a conventional organic EL device.

In a luminescent device according to the invention, a plurality of luminescing units are connected to respective current control parts by individual interconnections (for example the column electrode 1 interconnection discussed below; similarly hereinafter), and each current control part preferably has:

- a reference resistance (for example the $R_{ref}$ discussed below; similarly hereinafter) with which it is possible to monitor as a voltage the current flowing through each of the plurality of luminescing units;
- a current control device (for example the MOSFET discussed below; similarly hereinafter) connected between the reference resistance and the luminescing unit; and
- an operating and amplifying device (for example the operational amplifier OPA discussed below; similarly hereinafter) for comparing the monitored voltage with a brightness signal voltage from outside and outputting a control voltage to the current control device.

In this case, the potential difference across the reference resistance is preferably so controlled by the operating and amplifying device that it does not become larger than the brightness signal voltage.

Also, the brightness signal voltage from outside is preferably inputted into the operating and amplifying device as pre-programmed memory information (for example image information stored in the programmable ROM discussed below).

In the luminescent device of the invention, specifically, two pluralities of line-form electrodes are arranged one above the other and intersecting in a matrix, and a pixel is formed at each of these intersections; one plurality of line-form electrodes (for example the column electrodes 1 discussed below; similarly hereinafter) are each connected to a current control part and the other plurality of line-form electrodes, (for example the line electrodes 5 discussed below; similarly hereinafter) are each connected to a driving power supply (for example the $V_c$ discussed below; similarly hereinafter) and driven by a control signal. In particular, the luminescent device is preferably constructed as an organic electroluminescent device having a passive matrix (simple matrix) pixel structure. This is advantageous not only in that the device construction is simple compared to an active matrix of TFTs (Thin Film Transistors) or the like but also in the point that it is possible to certainly control the brightnesses of the pixels just by providing the above-mentioned current control parts.

In the driving method of the invention, preferably, the current flowing through each of a plurality of luminescing units is monitored as a voltage and this monitored voltage and a brightness signal voltage from outside are compared to control a current control device.

In this case, the monitored voltage is preferably controlled so that it does not become larger than the brightness signal voltage.

Also, the brightness signal voltage from outside is preferably supplied as pre-programmed memory data.

In the driving method of the invention, specifically, two pluralities of line-form electrodes are arranged one above the other and intersecting in a matrix and a pixel is formed at each of these intersections; one plurality of line-form electrodes are each connected to a current control part and the other plurality of line-form electrodes are each connected to a driving power supply and driven by a control signal. In particular, an organic electroluminescent device having a passive matrix (simple matrix) pixel structure is preferably driven.

A preferred embodiment of the invention will now be described in detail.

FIG. 5 through FIG. 17 show a preferred embodiment of the invention applied to an organic EL device.

Figure 7:
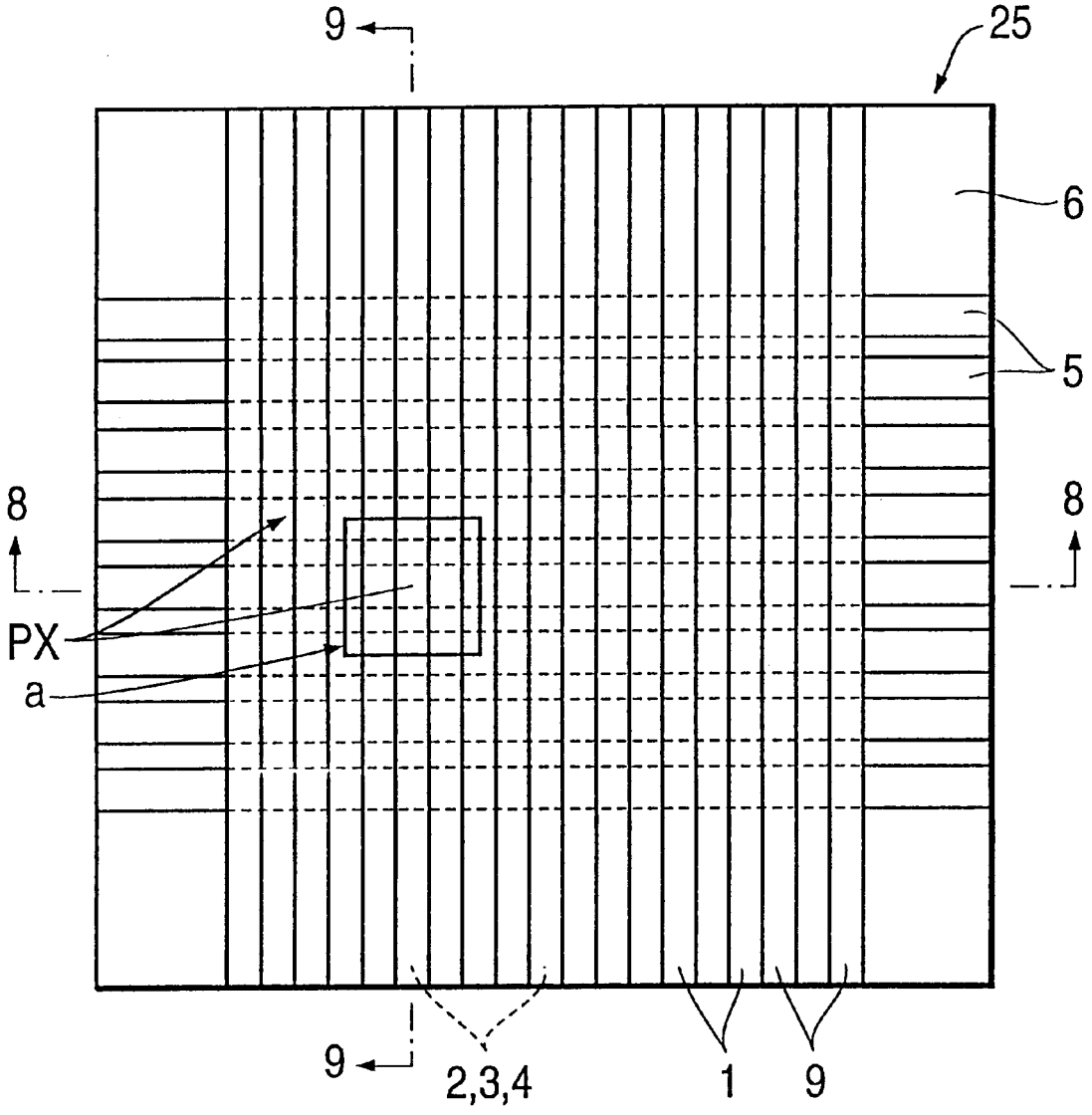
FIG. 7 is a schematic plan view of the same organic EL device.
Figure 8:
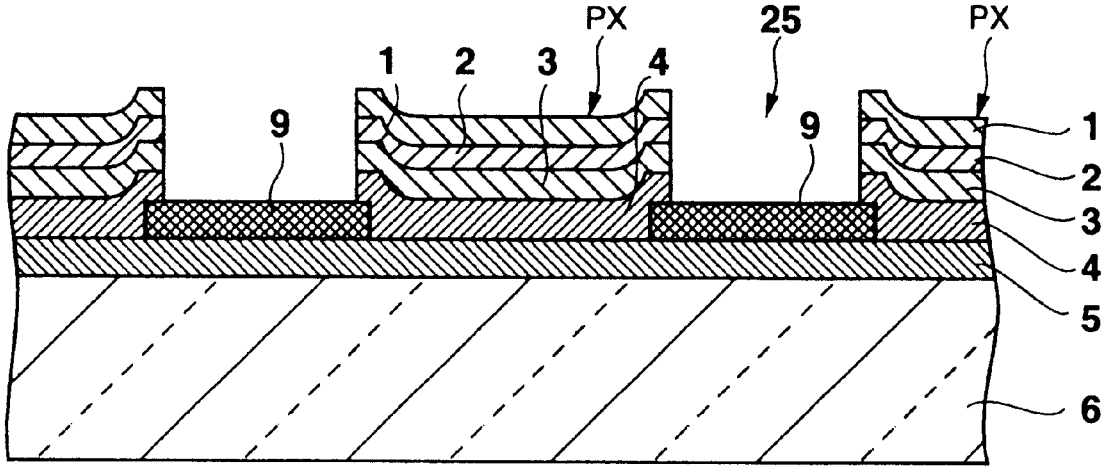
FIG. 8 is an enlarged sectional view on the line 8—8 of the part 'a' in FIG. 7.
Figure 9:
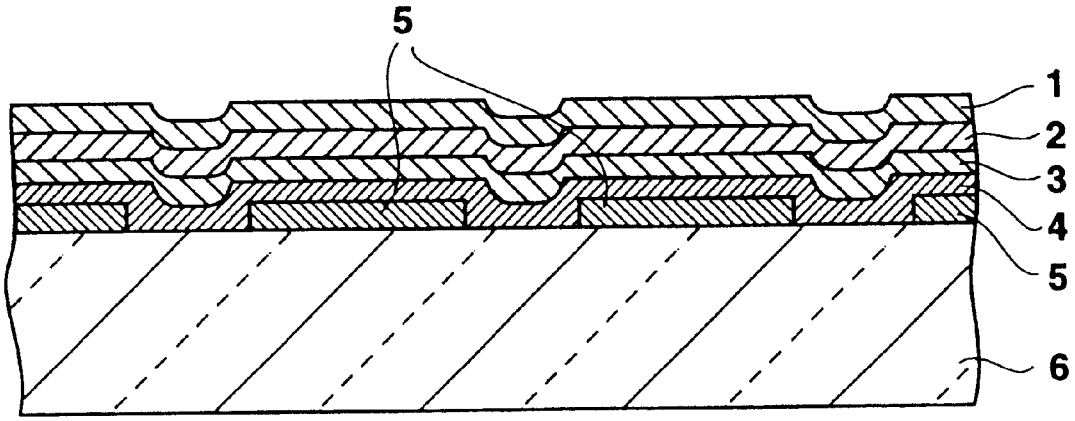
FIG. 9 is an enlarged sectional view on the lines of 9—9 the part 'a' in FIG. 7.

First, the construction of an organic EL device according to the invention will be described, FIG. 7 is a schematic plan view of an organic EL device 25, and FIG. 8 and FIG. 9 are enlarged sectional detail views of the same device. That is, FIG. 8 is an enlarged sectional view on the line 8—8 of the part 'a' in FIG. 7, wherein the parts where upper and lower electrodes intersect are pixels PX. FIG. 9 is an enlarged sectional view of the part 'a' on the line 9—9.

For example ITO transparent electrodes 5 are formed in the shape of stripes each of the same pattern on the upper surface of a transparent substrate 6, and $SiO_2$ insulating films 9 are formed in the shape of stripes each of the same pattern on the transparent electrodes 5 and intersecting with these electrodes in the form of a matrix. Between the insulating films 9, a hole transfer layer 4, a luminescent layer 3, an electron transfer layer 2 and an aluminum electrode 1 are stacked in this order and in substantially the same pattern, and these stacks are formed in the shape of stripes in the same direction and in the same pattern as the insulating films 9.

Next, an organic EL device according to the invention will be described in further detail with reference to a manufacturing process shown in FIG. 10 through FIG. 17.

Figure 10:
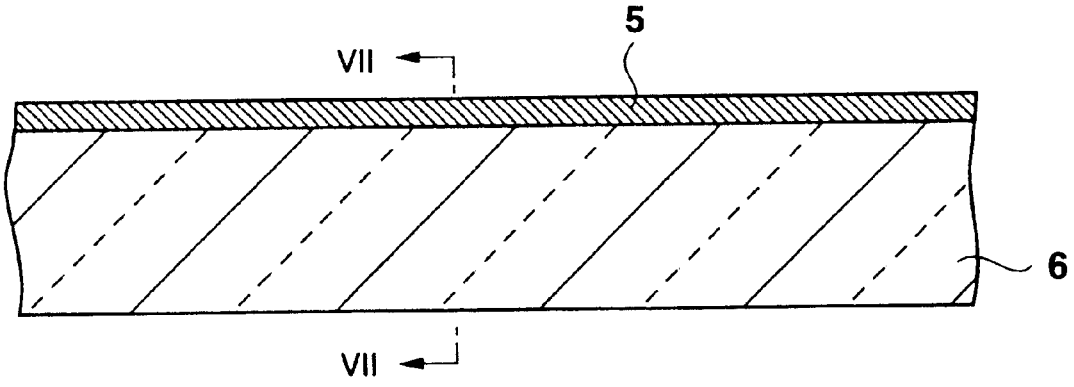
FIG. 10 is an enlarged sectional detail view illustrating a process for manufacturing the organic EL device.
Figure 11:
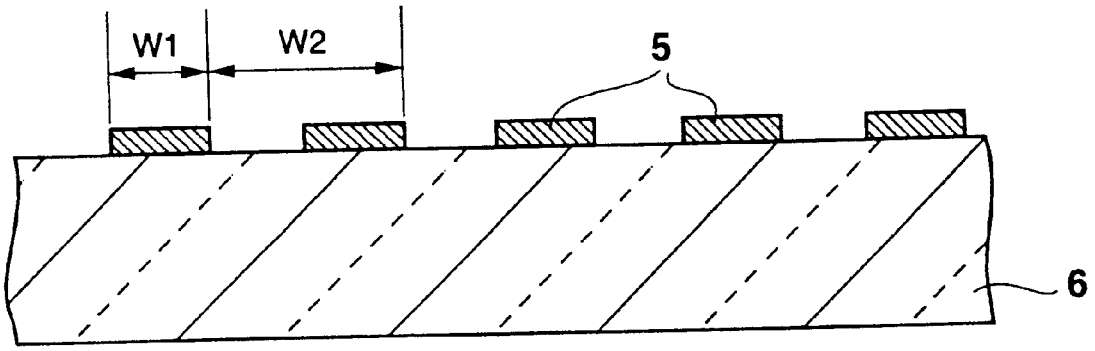
FIG. 11 is an enlarged sectional detail view on the line VII—VII in FIG. 10.

First, as shown in FIG. 10, an ITO (Indium Tin Oxide) film is formed by sputtering on the entire surface of a transparent substrate 6 made of 1.1 mm thick float glass and then, as shown in FIG. 11 (a sectional view on the line VII—VII in FIG. 10), transparent electrodes 5 are formed by etching in a stripe pattern of stripe width $w_1$=2 mm, pitch $w_2$=2.54 mm with eight stripes as a unit. The resistance between the ends of each of these eight transparent electrodes 5 is made about 300Ω.

Figure 12:
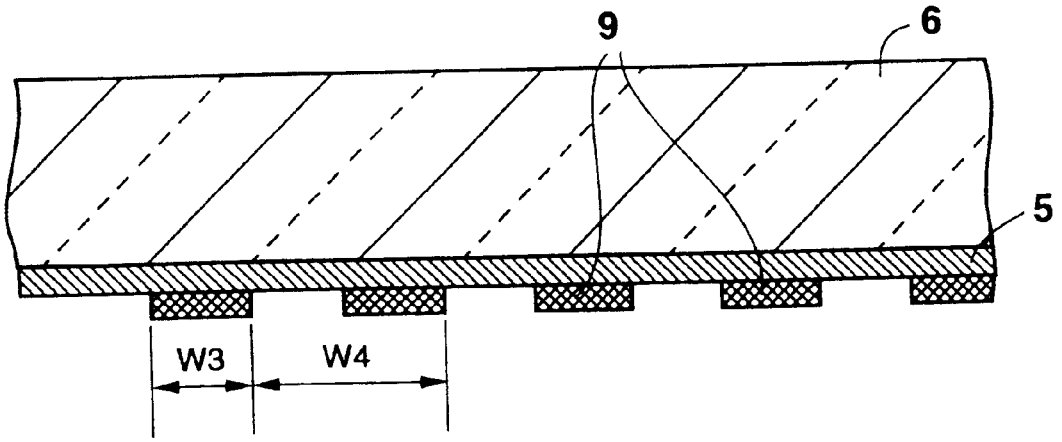
FIG. 12 is another enlarged sectional detail view illustrating the manufacturing process.

Next, as shown in FIG. 12, an $SiO_2$ insulating film 9 for insulating organic stacks which will be further discussed later is deposited on the entire surface of the $SiO_2$ and then formed into stripes by etching. The width $w_3$ of the stripes is 1 mm, the pitch $w_4$ is 2.54 mm and the thickness t is 100 nm.

Figure 13:
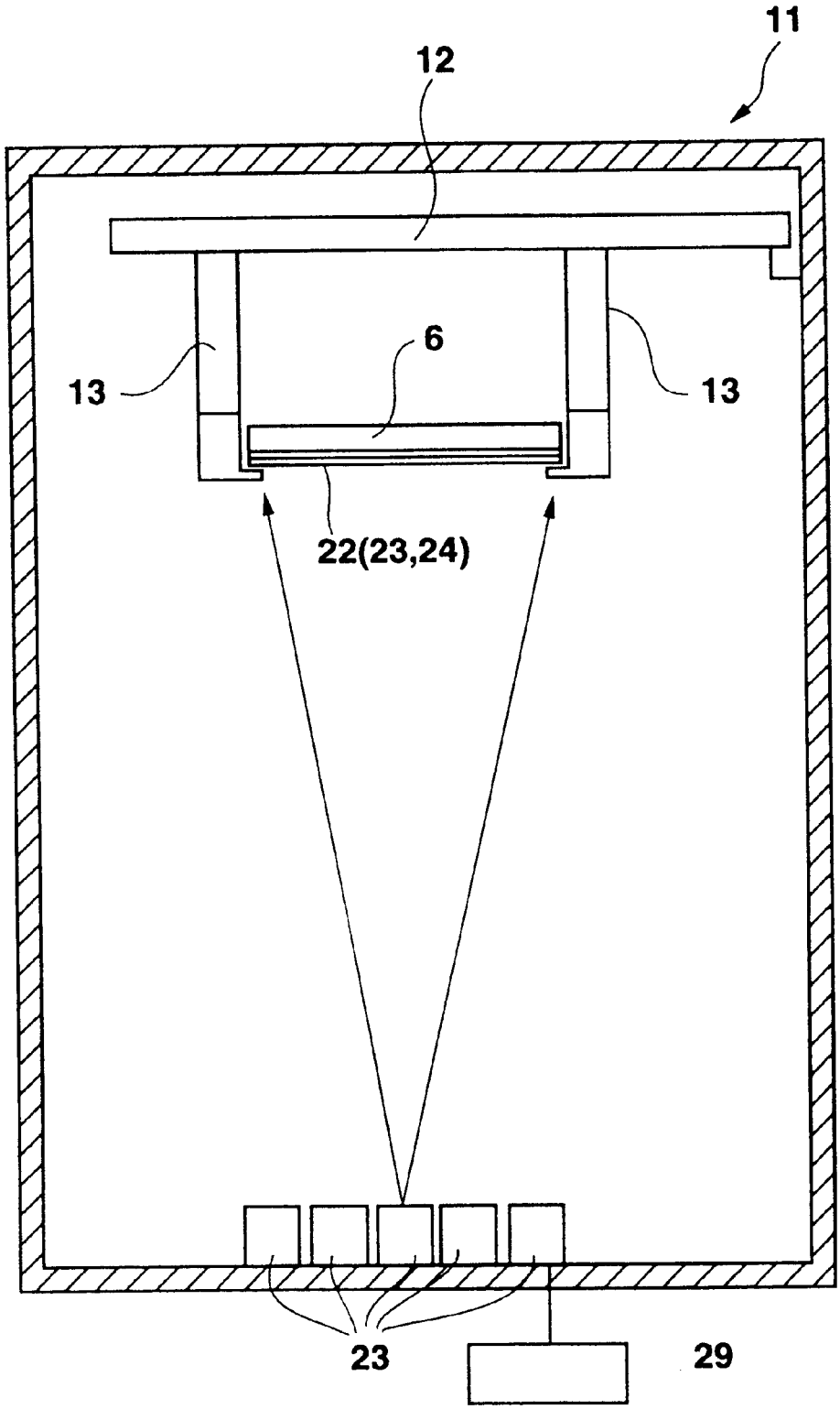
FIG. 13 is a schematic view of a vacuum vapor deposition apparatus which can be used in the manufacturing process.

For the deposition of organic layers (a hole transfer layer 4, a luminescent layer 3 and an electron transfer layer 2) and aluminum electrodes 1, a vacuum vapor deposition apparatus 11 of the kind shown in FIG. 13 is used. A pair of supporting means 13 fixed to the underside of an arm 12 are mounted inside this apparatus, and a stage mechanism (not shown) with which it is possible to set masks 22, 23 and 24 which will be further discussed later on the transparent substrate 6 facing downward is mounted between these two supporting means 13, 13. A predetermined number of vapor deposition sources 28 of different kinds are disposed below the transparent substrate and the masks. The vapor deposition sources 28 are heated by resistance heating using a power supply 29. Where necessary, EB (electron beam) heating or the like may also be used for this heating.

After the surface of the transparent substrate 6 with the $SiO_2$ insulating film 9 formed thereon is well cleaned with an organic solvent and ultraviolet light (UV) ozone treatment, by means of the vacuum vapor deposition apparatus 11 described above, to form adjacent stripes emitting light of the three colors red (R), green (G) and blue (B), deposition of organic layers and metal electrodes is carried out using a different deposition mask for each color by the following procedure.

Figure 14:
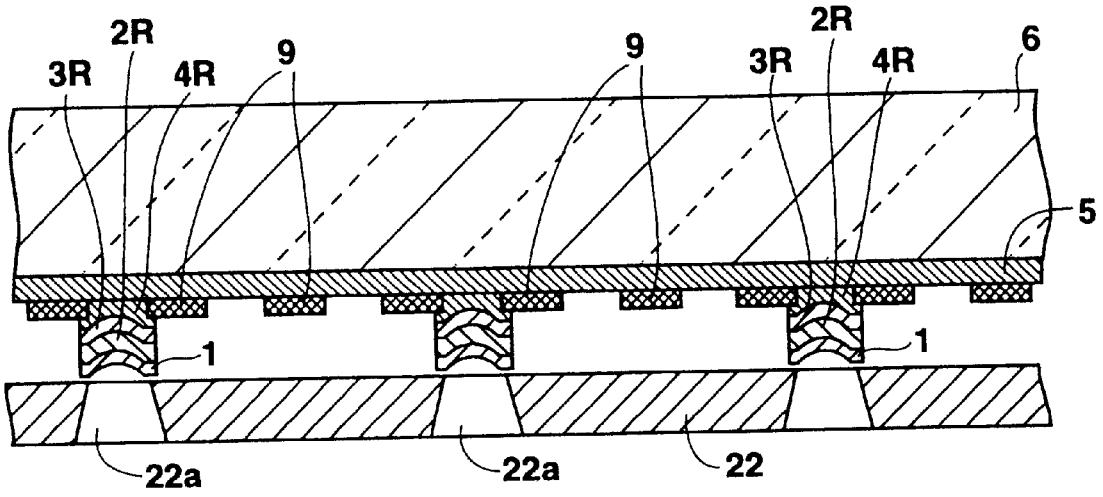
FIG. 14 is another enlarged sectional detail view illustrating the manufacturing process.

First, the transparent substrate 6 and the mask 22 for red (R) are set in the vacuum vapor deposition apparatus 11. FIG. 14 is an enlarged sectional view of parts of the transparent substrate 6 and the mask 22 showing the positional relationship between the two. As shown in FIG. 14, for deposition, slit-shaped openings 22*a* in the mask 22 are aligned with the areas between the insulating films 9—9 (mask setting). The openings 22*a* in the mask 22 are formed at a spacing of one opening 22*a* every three of the areas between the insulating films 9—9. Therefore, areas for luminescent bodies other than the red (R) ones are covered as a result of this mask setting.

After the mask 22 for the color red (R) is set in this way, the vacuum vapor deposition apparatus is kept at a vacuum of $2\times10^{-6}$ Torr and a hole transfer layer 4R is formed by depositing a triphenyldiamene derivative TPD (N,N'-bis (3-methylphenyl) 1,1'-biphenyl-4,4'-diamine) of the structural formula (Formula 1) below to a thickness of 50 nm at a deposition rate of 0.3 nm/s.

Then, using the same mask 22 unchanged, a luminescent layer 3R was formed on the hole transfer layer 4R in substantially the same pattern thereas by depositing $Alq_3$ (tris-(8-hydroxyquinoline) aluminum) of the structural formula (Formula 2) below and laser pigment DCM (4-dicyanomethylene-6-(p-dimethylaminostyril)-2-methyl-4H-pyran) of the structural formula (Formula 3) below to a thickness of 20 nm at deposition rates of 0.3 nm/s and 0.03 nm/s respectively.

Then, still using the same mask 22 unchanged, an electron transfer layer 2R was formed on the luminescent layer 3R in substantially the same pattern thereas by depositing $Alq_3$ (tris-(8-hydroxyquinoline) aluminum) of the structural formula (Formula 2) below to a thickness of 40 nm at a deposition rate of 0.3 nm/s, and finally an electrode 1 was formed on the electron transfer layer 2R in substantially the same pattern thereas by depositing aluminum to a thickness of 300 nm at a deposition rate of 2 nm/s.

(Formula 1)

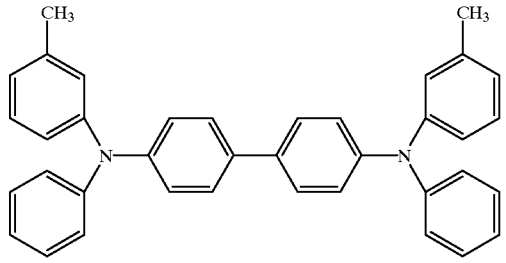

Structure of TPD (Formula 2)

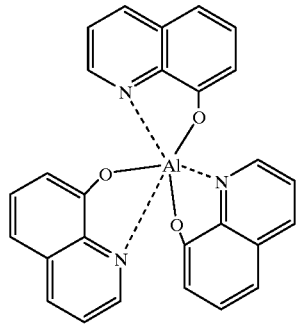

Structure of $Alg_3$ (Formula 3)

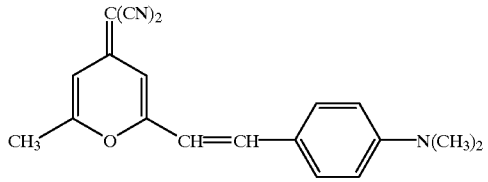

Structure of DCM

Figure 15:
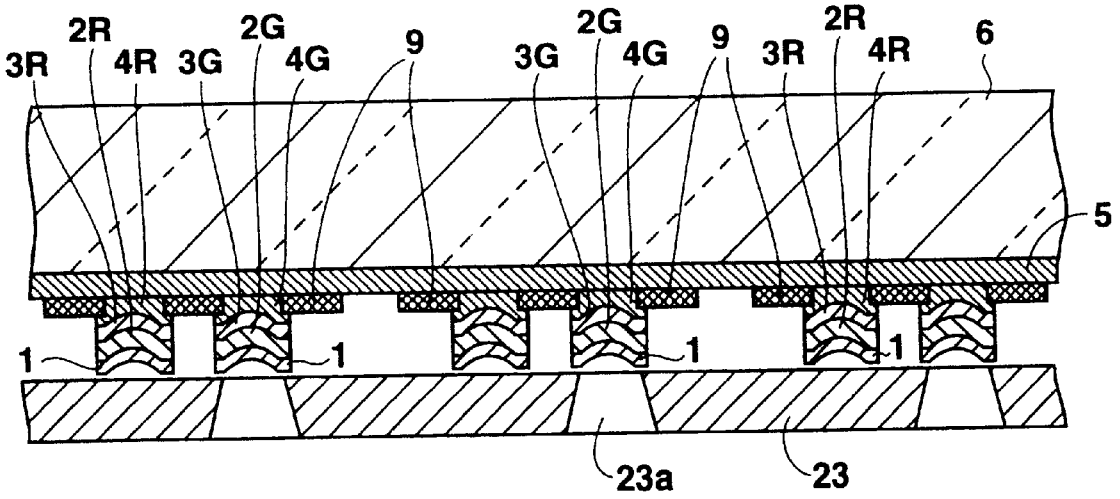
FIG. 15 is another enlarged sectional detail view illustrating the manufacturing process.

Next, as shown in FIG. 15, the mask 22 is replaced with the mask 23 for the color green (G). This mask 23, as shown in the figure, is positioned so that slit-shaped openings 23*a* therein are aligned with areas between the insulating films 9—9 adjacent to the areas where the layers deposited using the mask 22 for the color red (R) were formed. The mask 23 is formed in the same pattern as the mask 22 for the color red (R) and covers areas for luminescent bodies other than the green (G) ones.

After the mask 23 for the color green (G) is set in this way, the vacuum vapor deposition apparatus is kept at a vacuum of $3\times10^{-6}$ Torr and first a hole transfer layer 4G is formed by depositing the above-mentioned triphenyldiamene derivative TPD to a thickness of 50 nm at a deposition rate of 0.3 nm/s.

Then, using the same mask 23 unchanged, a luminescent layer 3G is formed on the hole transfer layer 4G in substantially the same pattern thereas by depositing the above-mentioned $Alq_3$ to a thickness of 50 nm at a deposition rate of 0.3 nm/s. This luminescent layer doubles as an electron transfer layer 2G.

Also, an electrode 1 is formed on the luminescent layer 3G (and electron transfer layer 2G) in substantially the same pattern thereas by depositing aluminum thereon to a thickness of 300 nm at a deposition rate of 2 nm/s.

Figure 16:
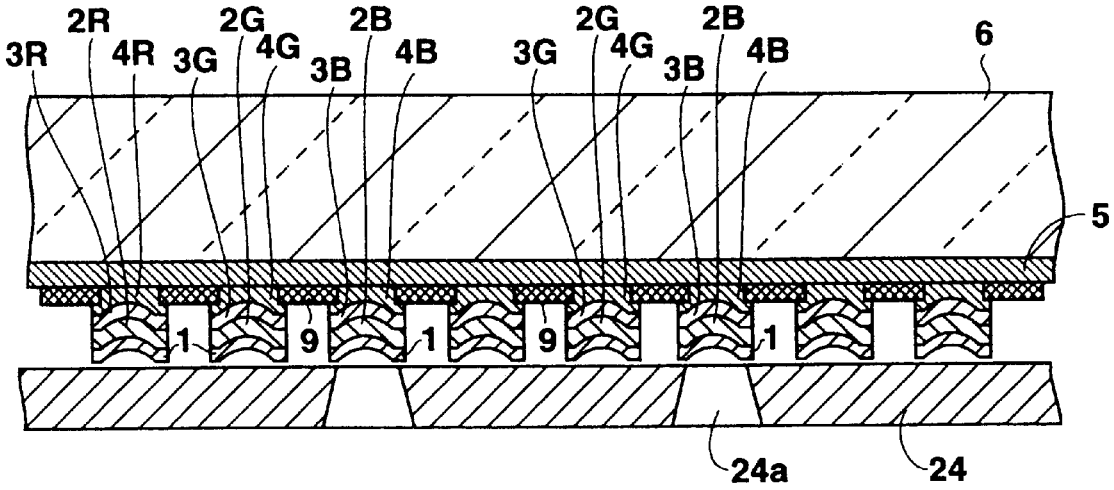
FIG. 16 is another enlarged sectional detail view illustrating the manufacturing process.

Next, as shown in FIG. 16, the mask 23 is replaced with the mask 24 for the color blue (B). This mask 24, as shown in the figure, is positioned so that slit-shaped openings 24*a* therein are aligned with areas between the insulating films 9—9 adjacent to the areas where the layers deposited using the mask 23 for the color green (G) were formed. The mask 24 is formed in the same pattern as the masks for the color red (R) and for the color green (G) and covers areas for luminescent bodies other than the blue (B) ones.

After the mask 24 for the color blue (B) is set in this way, the vacuum vapor deposition apparatus is kept at a vacuum of $3\times10^{-6}$ Torr and first a hole transfer layer 4B is formed by depositing the above-mentioned triphenyldiamene derivative TPD to a thickness of 50 nm at a deposition rate of 0.3 nm/s.

Then, using the same mask 24 unchanged, a luminescent layer 3B is formed on the hole transfer layer 4B in substantially the same pattern thereas by depositing $Zn(oxz)_2$ (a zinc complex of 2-(o-hydroxyphenyl)-benzoxazole) of the structural formula (Formula 4) below to a thickness of 50 nm at a deposition rate of 0.3 nm/s. This luminescent layer doubles as an electron transfer layer 2B.

Finally, an electrode 1 is formed on the luminescent layer 3B (and electron transfer layer 2B) in substantially the same pattern thereas by depositing aluminum thereon to a thickness of 300 nm at a deposition rate of 2 nm/s.

(Formula 4)

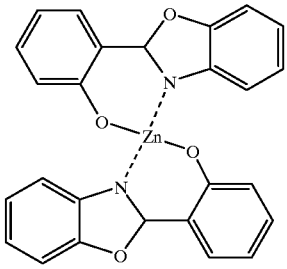

Figure 5:
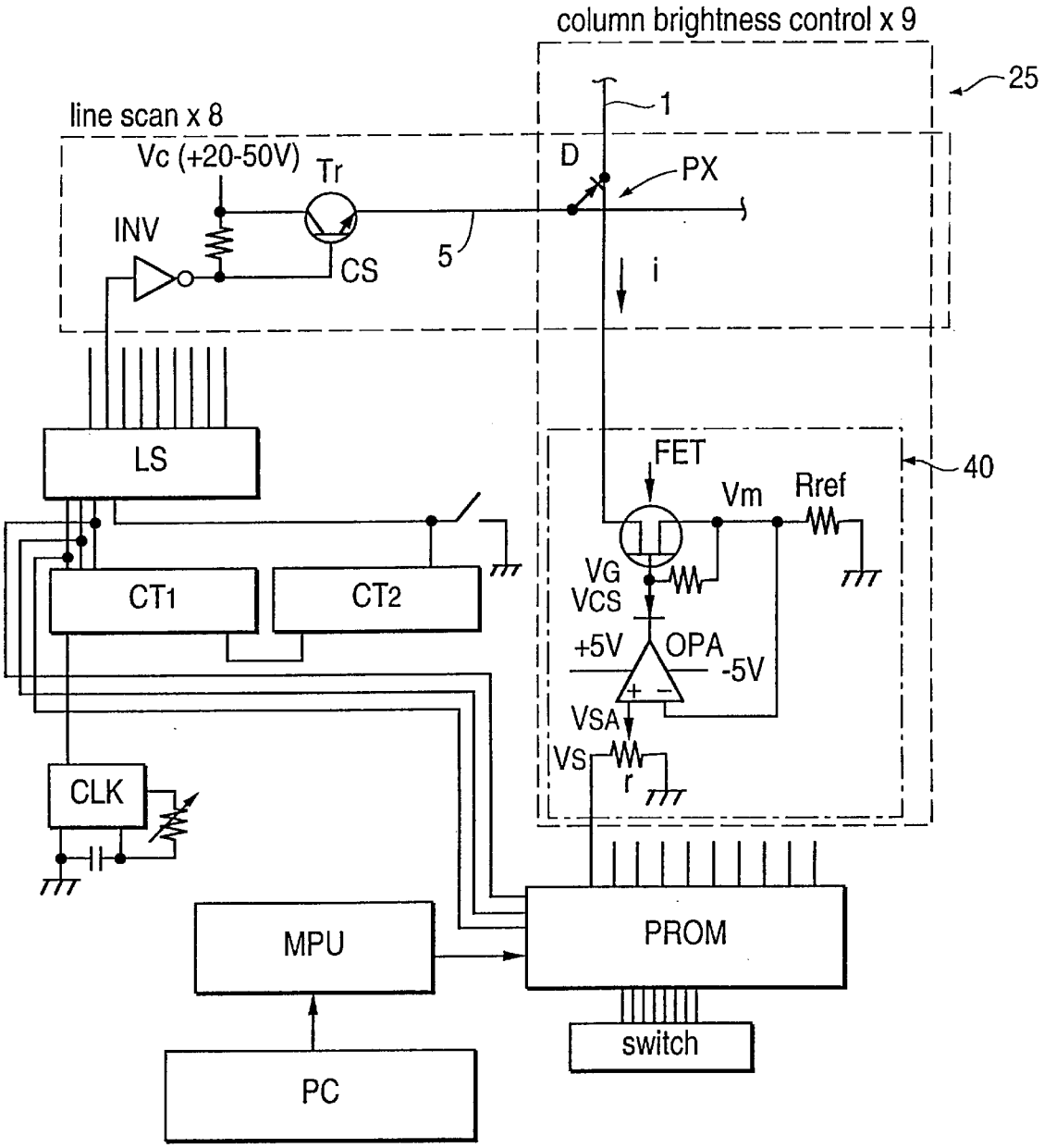
FIG. 5 shows a driving circuit of an organic EL device according to a preferred embodiment of the invention.
Figure 17:
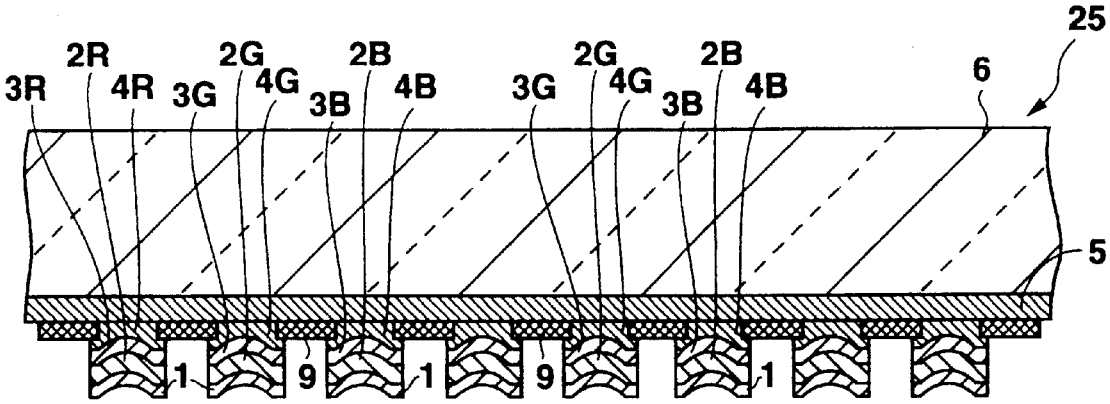
FIG. 17 is a further enlarged sectional detail view illustrating the manufacturing process.

Structure of Zn(oxz);

FIG. 17 shows an organic EL device 25 obtained by laminating organic layers and electrodes (cathodes) using the same mask for the predetermined color by vapor deposition color by color in the manufacturing process described above. FIG. 5 shows how anode transparent electrodes 5 and cathode metal electrodes 1 are connected to a driving/control circuit, and the operation of this circuit will be discussed later.

The interchanging of the masks in the manufacturing process described above was carried out both in the vacuum and with the vacuum released and the deposited films exposed to the atmosphere, and there was no great difference in the initial luminescing performances of the resulting devices when they were driven.

An organic EL device 25 according to the preferred embodiment described above was illuminated by the so-called dynamic drive method by a driving circuit shown in FIG. 5 having current control circuit parts based on the invention.

This driving circuit is so constructed that it can control the device current (the current flowing through the pixel PX) i according to a brightness signal from outside using an operational amplifier OPA.

That is, stripe-shaped column electrodes (the above-mentioned electrodes 1) and stripe-shaped line electrodes (the above-mentioned transparent electrodes 5) are arranged one above the other and intersecting in the form of a matrix, and pixels PX are formed in a passive matrix structure where the upper and lower electrodes intersect. Each of the pixels PX can be considered equivalent to a diode D connected in a forward direction. The column electrodes 1 are each connected to a respective current control circuit part 40 and the line electrodes 5 are each connected to a respective driving power supply $V_c$ and driven by a control signal CS. This driving circuit and its operation will now be described in further detail.

As shown in FIG. 5, each of the current control circuit parts 40 comprises a reference resistance $R_{ref}$ with which it is possible to monitor a current i flowing through each of numerous pixels PX as a voltage $V_m$, a FET (Field Effect Transistor) as a current control device connected between this reference resistance $R_{ref}$ and the pixels PX, and an operational amplifier OPA for comparing the monitored voltage $V_m$ with a brightness signal voltage $V_s$ supplied from a PROM (Programmable Read Only Memory) outside the current control circuit part 40 and outputting a control voltage $V_{CS}$ to the FET.

Picture information to be displayed with the organic EL device 25 is pre-programmed into the PROM and stored there. This is inputted into the PROM on the basis of instructions from a microprocessing unit MPU operated by a personal computer PC, and the picture information is sampled and a predetermined brightness signal voltage $V_S$ is outputted from the PROM. This brightness signal voltage is adjusted to a required voltage value using a resistor r, and this adjusted voltage $V_{SA}$ is inputted to the +terminal of the operational amplifier OPA.

To illuminate the pixels PX, a drive transistor (here, an NPN bipolar transistor) Tr is connected between the power supply $V_C$ and the pixels PX and the line electrodes 5 are successively switched between by a control voltage CS for switching being selectively impressed on the base of this transistor. As a result, when the drive transistor Tr is switched on by the control voltage CS, the power supply voltage $V_C$ is impressed on that line electrode 5, a current i consequently flows between this line electrode 5 and the column electrode 1 and the pixel PX lights up.

This illumination operation continues for as long as the 'on' state of the FET caused by the above-mentioned brightness signal voltage continues at the same time as the power supply voltage $V_C$ is impressed on the line electrode 5 (i.e. while the current i flows), and because this operation is carried out for each line in accordance with the brightness signal the target display image is obtained from the organic EL device 25.

In this case, the current i flowing through the pixel PX should flow in correspondence with the luminescing brightness required there, and this can be realized by means of the current control circuit part 40. This is explained below.

The above-mentioned brightness signal voltage $V_{SA}$ is inputted into the +terminal of the operational amplifier OPA, and as a result of the current i flowing through the reference resistance $R_{ref}$ a potential difference arising across the ends of the reference resistance $R_{ref}$ (the above-mentioned monitored detected voltage $V_m$) is inputted into the −terminal of the operational amplifier OPA.

Under the condition that $V_{SA}>V_m$, the output $V_{CS}$ of the operational amplifier OPA rises, the gate voltage $V_G$ of the FET rises, $V_m-V_G$ becomes small and lowers the source-drain resistance of the FET and increases the current i. When i increases in this way and $i\cdot R_{ref}=V_m$ reaches $V_{SA}$, $V_{CS}$ ceases to rise and the resistance value of the FET stabilizes and i stabilizes to a constant value $V_m/R_{ref}$.

Figure 6:
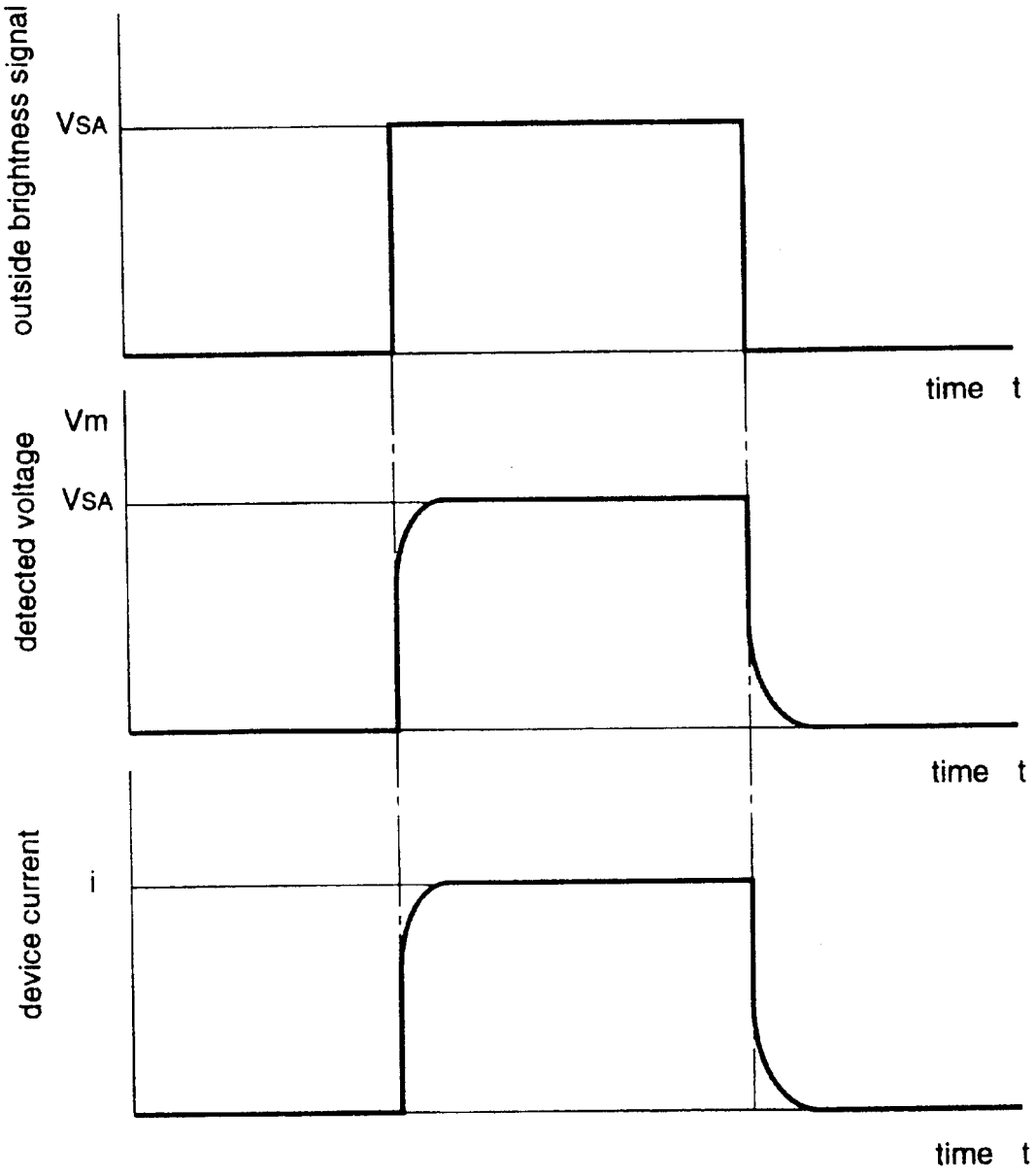
FIG. 6 is a timing chart of device current control performed by the same driving circuit.

Therefore, while the brightness signal voltage from the PROM is being impressed, until this brightness signal voltage $V_{SA}$ and the detected voltage $V_m$ become the same, the current i flows through the FET serving as a variable resistance and the current flowing through the pixel PX changes until it reaches the target current level and as a result the required luminescing brightness is obtained at all times. A timing chart of this operation is shown in FIG. 6.

Explaining the switching operation of the line electrode 5 on the power supply voltage $V_C$ side, a clock pulse from an oscillator CLK consisting of a clock generator is inputted into a counter $CT_1$, a line selector for switching is operated every predetermined number of counts by a combination of this counter $CT_1$ with another counter $CT_2$ having the same number of bits, and a voltage of a level TTL is outputted to a predetermined selected line. This output is inverted by an invertor INV, and this inverted output is impressed. on the base of the drive transistor Tr as the control signal CS, and as described above the power supply voltage $V_C$ is supplied to the line electrode 5 through the transistor Tr switched on by this impressed voltage. The above-mentioned PROM is clock-controlled by the counter $CT_1$.

Explaining now an example of a specific operation using the driving circuit shown in FIG. 5, 35V for illuminating the pixels PX was applied and adjustment made so that a current of 32 mA would flow through each pixel PX. When switching between lines was successively carried out at 63.5 $\mu$s and the illuminated time ratio (duty ratio) of each pixel was 1/256, a peak brightness of 25,600 cd/m$^2$ and an average brightness of 100 cd/m$^2$ were obtained.

As described above, because the amount of current flowing through the pixels PX is controlled by means of the driving circuit of FIG. 5, it is possible to control the brightnesses of the pixels accurately and realize distinct luminescing (image display) at all times.

A specific preferred embodiment of the invention was described above, but the invention is not limited to the preferred embodiment described above and various changes are possible on the basis of the technological concept of the invention.

For example, it is possible to construct the driving circuit of FIG. 5 to carry out current control even more accurately for instance by providing the current control circuit part 40 with a voltage hold circuit or making suitable changes to constituent devices. Also, various changes may be made to the circuit for supplying a brightness signal voltage from outside, and the PROM may be operated in conjunction with the line selector LS. Furthermore, in the PROM the picture signal may be sample-held or may be sampled and then A/D converted.

Figure 2:
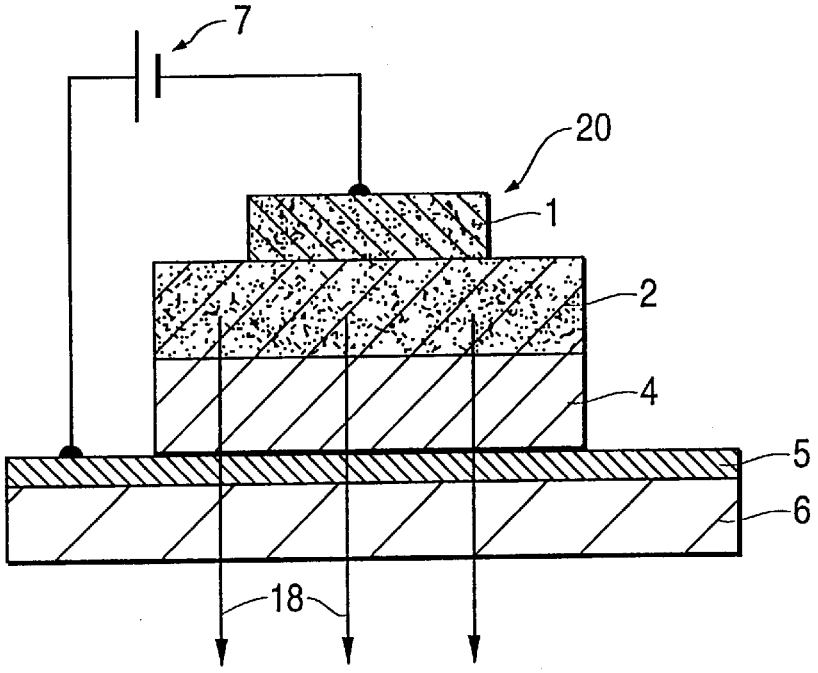
FIG. 2 PRIOR ART
FIG. 2 is a schematic sectional view of another example of a conventional organic EL device.
Figure 3:
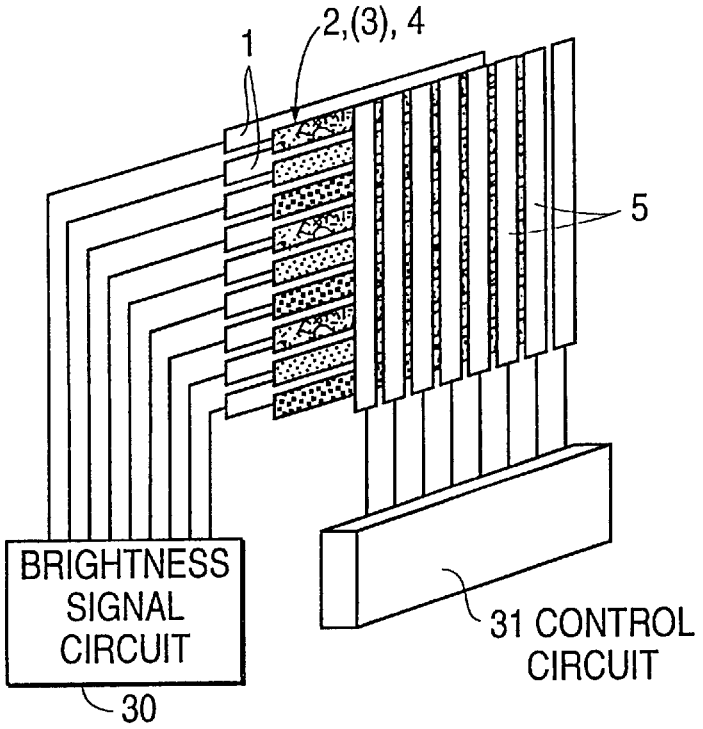
FIG. 3 PRIOR ART
FIG. 3 is a schematic perspective view of a passive display comprising conventional organic EL devices.
Figure 4:
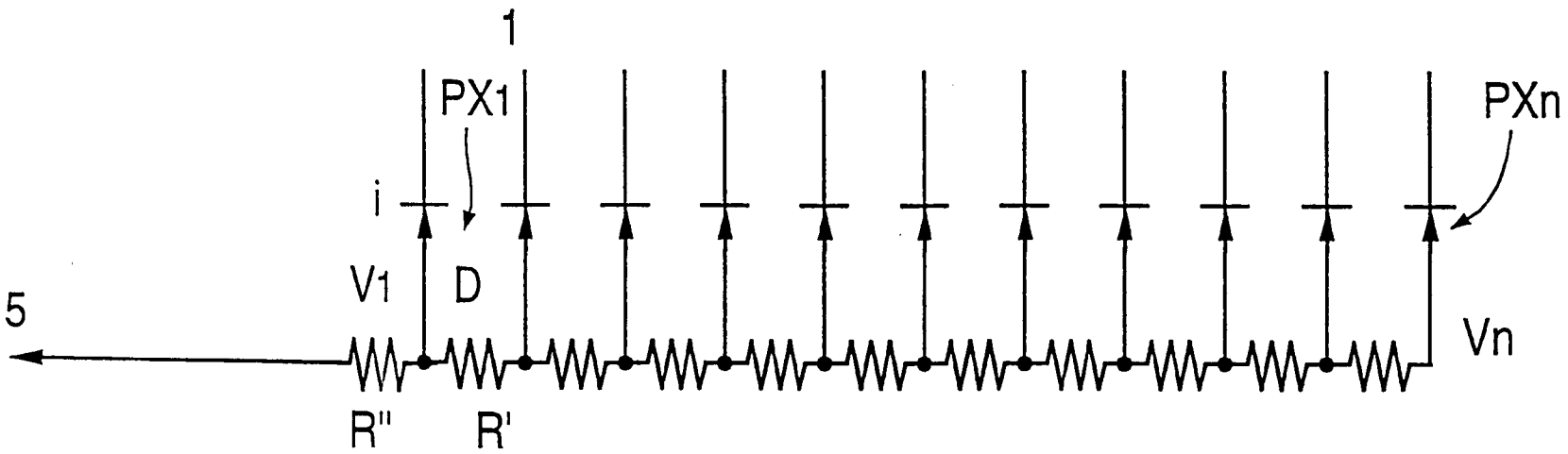
FIG. 4 PRIOR ART
FIG. 4 is an equivalent circuit of a line of a conventional organic EL device.

The thicknesses of the electrodes, the hole transfer layers, the luminescent layers and the electron transfer layers are determined in consideration of the operating voltage of the device and are not limited to those in the preferred embodiment described above. Also, the compositions and dispositions of these layers and the pattern and layout, etc. of the pixels can also be variously changed. For example, the EL device may be made of the construction shown in FIG. 2.

Also, as the method by which the layers of the device are made, as well as ordinary vapor deposition and Langmiur-Blodgett (LB) vapor deposition, dip coating, spin coating, vacuum gas deposition and organic molecule beam epitaxy (OMBE) can be employed. A fluorescent substance may be included in the hole transfer layer or the electron transfer layer.

What is claimed is:

1. A luminescent device comprising:

a plurality of luminescing units arranged in a display matrix and so constructed that each of said luminescing units is selectively made to luminesce at a selected brightness by an electric current flowing therethrough;

first and second pluralities of line-form electrodes, wherein electrodes of said first plurality intersect electrodes of said second plurality thereby forming said display matrix with a luminescing unit at each intersection, said luminescing units comprising a light-emitting pixel connected at each intersection between intersecting electrodes;

wherein said first plurality of line-form electrodes is connected to a driving power supply;

wherein each of said second plurality of line-form electrodes is connected to a current control circuit for controlling the current flowing through each luminescing unit to control the brightness thereof in accordance with a brightness control signal;

wherein each of the plurality of luminescing units is connected to a respective current control circuit that comprises:

a reference resistance for monitoring the current flowing through each of the plurality of luminescing units as a voltage across the reference resistance;

a current control device responsive to a control voltage connected between each reference resistance and its respective luminescing unit; and an operational amplifier for comparing the monitored voltage with a voltage representative of the brightness control signal for the respective luminescing unit provided by a memory and outputting the control voltage to said current control device.

2. The luminescent device according to claim 1, wherein:

said voltage across the reference resistance is controlled by said operation amplifier so as to not become larger than the voltage representative of the brightness signal.

3. The luminescent device according to claim 1, wherein:

said brightness signal voltage is inputted into said operational amplifier from the memory.

4. The luminescent device according to claim 1, wherein each of said light-emitting pixels comprises an organic electroluminescent device.

5. A method of driving a luminescent device having a plurality of luminescing units where each luminescing unit is selectively made to luminesce by an electric current flowing therethrough, each of said luminescing units being formed by a plurality of line-form electrodes intersecting one another and a light-emitting pixel connected between said intersecting line-form electrodes, said method comprising the steps of:

providing power to said plurality of line-form electrodes with a driving power supply responsive to a control signal; and controlling the current flow through each of the luminescing units on the basis of a brightness control signal provided from a pre-programmed memory unit storing a brightness value associated with each of the luminescing units, wherein said step of controlling further comprises:

monitoring said current flowing through each of said plurality of luminescing units as a voltage wherein said monitored voltage is compared with said brightness control signal voltage thereby controlling said current control device, wherein said comparison is performed by an op-amp.

6. The driving method according to claim 5 wherein:

controlling said monitored voltage to not become larger than said brightness control signal voltage.

* * * * *